US006622336B2

(12) United States Patent
Jackson

(10) Patent No.: US 6,622,336 B2
(45) Date of Patent: Sep. 23, 2003

(54) CONNECTING APPARATUS FOR ATTACHING A SWEEPING IMPLEMENT TO A TRACTION VEHICLE

(75) Inventor: Kenneth E. R. Jackson, Saskatoon (CA)

(73) Assignee: The Toro Company, Bloomington, MN (US)

( * ) Notice: Subject to any disclaimer, the term of this patent is extended or adjusted under 35 U.S.C. 154(b) by 0 days.

(21) Appl. No.: 10/086,975

(22) Filed: Mar. 1, 2002

(65) Prior Publication Data

US 2002/0078516 A1 Jun. 27, 2002

Related U.S. Application Data

(62) Division of application No. 09/397,611, filed on Sep. 16, 1999, now Pat. No. 6,446,297.

(51) Int. Cl.[7] ..... E01H 1/05
(52) U.S. Cl. ..... 15/82; 15/78
(58) Field of Search ..... 15/49.1, 78, 82

(56) References Cited

U.S. PATENT DOCUMENTS

| | | | |
|---|---|---|---|
| 2,212,677 A | | 8/1940 | Wagner |
| 2,330,025 A | | 9/1943 | Bentley et al. |
| 4,658,458 A | * | 4/1987 | Berfield et al. |
| 4,811,442 A | | 3/1989 | Barker |
| 5,279,014 A | | 1/1994 | Wise et al. |
| 5,299,857 A | | 4/1994 | Zanetis |
| 5,426,805 A | | 6/1995 | Fisher |
| 5,732,781 A | | 3/1998 | Champers |
| 5,881,417 A | | 3/1999 | Knowlton |

FOREIGN PATENT DOCUMENTS

| | | |
|---|---|---|
| FR | 2405-332 | 5/1977 |

* cited by examiner

*Primary Examiner*—Randall E. Chin
(74) *Attorney, Agent, or Firm*—Fulbright & Jaworski L.L.P.

(57) ABSTRACT

A rotary brush assembly that is mounted to a traction vehicle, such as a skid steer type vehicle. The brush assembly is allowed to move relative to the traction vehicle within three degrees of freedom including yaw, roll, and up and down linear motion. The degrees of freedom reduce brush wear and facilitate more effective cleaning over uneven surfaces. Up and down linear motion is accommodated by a linear sliding joint. The sliding joint is further equipped with markings that indicate to the operator where, in the range of up and down motion, the brush is located. The brush assembly is also equipped with a mounting mechanism that translates motion of a skid steered vehicle implement arm joint into yaw motion of the brush. This eliminates the need for additional hydraulic cylinders or controls to actuate yaw motion.

13 Claims, 6 Drawing Sheets

CONNECTING APPARATUS FOR ATTACHING A SWEEPING IMPLEMENT TO A TRACTION VEHICLE

CROSS REFERENCE TO RELATED APPLICATIONS

This is a division of application Ser. No. 09/397,611, filed Sep. 16, 1999 now U.S. Pat. No. 6,446,297.

TECHNICAL FIELD

This invention pertains to ground sweeping devices. Specifically, this invention pertains to a rotary brush assembly, which in its preferred embodiment is an attachment to a skid steered vehicle or tractor.

BACKGROUND OF THE INVENTION

Rotary brush assemblies are used to sweep sand, snow, and other debris from sidewalks, roads or other ground surfaces. Configurations for rotary brushes are either transverse, where the brush axis of rotation is parallel to the ground, or vertical, where the brush axis of rotation is perpendicular to the ground. There are also single brush configurations and multiple brush configurations. The present invention deals primarily with a transverse single brush, but it would be clear to one skilled in the art that this invention could be applied to other brush orientations and multiple brush assemblies as well.

Because brush assemblies often weigh several hundred pounds, they are attached to and powered by traction vehicles. Frequently, the brush is attached to the front of a tractor or skid steer vehicle so the operator can see the brush and the ground at the same time and make adjustments to effectively clean the surface.

This invention addresses the problems of how to more effectively clean uneven surfaces, and how to minimize brush wear. A higher number of degrees of freedom in a brush assembly helps the brush conform better to uneven surfaces which makes cleaning more effective, and lessens brush wear. In addition to increasing the number of degrees of freedom, this invention describes novel ways to monitor and control movement of the brush within these degrees.

A degree of freedom in the motion of an object such as a brush assembly can be one of six types. There are three directions of linear motion and three types of rotational motion, each of which is a degree of freedom. Linear motion is non-rotational motion of an object along one of the three Cartesian coordinate axes, i.e. forwards/backwards, side to side, or up/down. Rotational motion is the spinning of an object about any one of the three Cartesian axes. For the purposes of this invention, the following terms will be used. The three linear degrees of freedom are described in common language terms such as forward/backward, up and down, and side to side. These linear directions will also be used to define axes of rotation for rotational motion. Rotation about the forward/backward axis will be called roll, rotation about the up/down axis will be called yaw, and rotation about the side to side axis will be called pitch.

Within the range of motion of any given degree of freedom, an object's position may either be controlled or free. For instance, in U.S. Pat. No. 5,732,781 a bucket attachment to a skid steer vehicle is rotatable about a "roll" axis as one of its degrees of freedom. In addition, the bucket rotation is controlled. The bucket attachment contains a hydraulic cylinder that allows the operator to choose an angle within the range of roll rotation to stop at. Once the operator chooses a position it is fixed until the operator makes further adjustments. In contrast, U.S. Pat. No. 5,426,805 and a commonly assigned pending patent application show rotary brushes that are also rotatable about a roll axis, but in these cases the rotation is not controlled. As the brush in U.S. Pat. No. 5,426,805 comes into contact with variations in terrain, the roll pivot joint allows the brush to rotate freely. Free joint motion is more desirable to accommodate changes in terrain because it allows the brush to conform to the terrain without requiring the operator to make numerous and frequent position adjustments.

U.S. Pat. No. 5,299,857 shows a rotary planer that is mounted on the front of a skid steered vehicle. The rotary planer in this prior art is moveable along the up/down linear axis, it is moveable along the linear side to side axis, and it is rotatable about the roll axis. All of these three degrees of freedom are operator controlled. Although controlled degrees of freedom are well suited to a planing operation where the objective is to remove surface variations, in a brushing application, surface variations need to be accommodated. When the roll degree of freedom on a rotary brush is fixed and an irregular slanted surface is encountered, the bristles at one end of the brush are excessively compressed, and at the other end of the brush the bristles may not contact the ground. This situation leads to the problems of excessive brush wear from the compressed bristles, and ineffective surface cleaning where the brush doesn't contact the ground.

The situation is also true of the up/down linear degree of freedom. Although the rotary implement in U.S. Pat. No. 5,299,857 can move along the up/down axis, it is controlled in this degree of freedom. In the case of a rotary brush, if a large bump is encountered, any joint allowing up/down motion must be a free joint. Otherwise the brush bristles will merely compress, which leads to excessive brush wear or uneven sweeping.

U.S. Pat. No. 4,811,442 addresses the issue of brush wear from encountering large uniform bumps. It shows a brush assembly where the brush is allowed to move up and down freely without over compressing the bristles. The solution in this prior art is to allow pitch rotation of the brush about a joint located near the tractor. A linkage then connects the brush frame to the pitch pivot joint. Because the brush in '442 is located far away from the pitch pivot joint, the rotational motion is along a small arc of a large radius, and is similar to up/down linear motion. The disadvantage of this design is that the brush must be located far away from the pitch pivot joint to achieve an effective range of motion. Brushes located farther away from the tractor tend to be cumbersome and hard to control.

Sometimes it is to the advantage of the operator to control one of the degrees of freedom. In the case of yaw, the angle that the brush is set at determines where the debris is swept. If this angle is not adjustable, the brush assembly will only be able to sweep to one side of the tractor. If the yaw pivot joint is not controlled, the angle will change unpredictably with changes in the surface being swept, and the operator will not be able to control where the debris goes.

U.S. Pat. No. 4,811,442 shows a brush assembly that is attached to a skid steer type vehicle where the yaw is controlled by means of a hydraulic cylinder. The disadvantage of this design is that it requires a connection to the hydraulic system on the skid steer vehicle and a separate control for the operator. These extra features are expensive and make the attachment of the brush assembly more time consuming.

SUMMARY OF THE INVENTION

The present invention includes a rotary brush assembly for use with a traction vehicle. The brush assembly includes a brush support frame and a rotary brush that is operatively connected to the brush support frame. The brush assembly also includes a roll pivoting joint permitting rotation of the frame about a first axis substantially parallel to the forward direction of vehicle travel when the brush support frame is in its normal or centered position. The brush assembly also includes a yaw pivoting joint permitting rotation of the frame about a second axis substantially perpendicular to the ground. The brush assembly also includes a linear sliding joint that allows the brush to rise and fall in a direction substantially perpendicular to the ground.

The brush assembly might include a rotary brush rotating about an axis of rotation substantially parallel to the ground. It might also include a roll pivoting joint that permits free movement of the frame about the first axis as the brush encounters uneven features, and a linear sliding joint that permits free movement of the frame up and down in a direction substantially perpendicular to the ground, wherein movement of the frame about the second axis of rotation is controlled by the operator. The yaw pivoting joint and the sliding joint might be coaxial. The sliding joint might allow three inches or more of travel in either direction from a centered position. The brush assembly might be mounted substantially below an implement arm.

The present invention might include an indicating device for monitoring the range of up and down motion in a rotary brush assembly. The indicating device has a first frame that holds a rotary brush and a second frame for operatively connecting the first frame to a traction vehicle. The indicating device also includes a joint allowing up and down motion of the first frame relative to the second frame. The indicating device also includes a first indicating marker attached to the first frame, and a second indicating marker attached to the second frame. The degree of movement between the first and second frame is thus indicated by the relative positions of the first and second indicating markers.

The indicating device might be used with a rotary brush assembly where the rotary brush rotates about an axis of rotation substantially parallel to the ground. The indicating device might include a joint between the two frames that is a linear sliding joint. The indicating device might also have first and second indicating markers that are comprised of line markings.

The present invention might include a mechanism for attaching a rotary brush assembly to a traction vehicle. The mechanism includes an implement arm extending from the traction vehicle that the brush assembly is operatively connected to. The mechanism has a controlling surface located at the end of the implement arm. The controlling surface rotates about a pivot joint axis of rotation located at the end of the implement arm. The mechanism includes a first frame that holds a rotary brush and a second frame that is operatively connected to the implement arm with a frame joint located between the first and second frame permitting relative motion between the first and second frame. The mechanism also has a linkage that is operatively connected to the controlling surface and the first frame. The linkage translates pivoting motion of the controlling surface about the pivot joint axis of rotation into motion of the first frame relative to the second frame.

The mechanism attaching a rotary brush assembly to a traction vehicle might also include a frame joint that is a yaw pivoting joint, wherein pivoting motion of the controlling surface about the pivot joint axis of rotation is translated into rotation of the first frame about a yaw axis of rotation.

The mechanism attaching a rotary brush assembly to a traction vehicle might be operatively connected to the implement arm by a clamp, the clamp being capable of lengthening and contracting while maintaining a clamping force.

The clamp might be comprised of a shaft having first and second ends, wherein the first end of the shaft is operatively connected to the second frame. The clamp might also include a clamping actuator for applying a clamping force, the actuator being operatively connected to the second end of the shaft. The clamp might also include a clamping surface located proximate to the shaft, between the implement arm and the clamping actuator, the clamping surface contacting the implement arm. The clamp might also include a deformable insert that is located along the shaft between the clamping actuator and the clamping surface, wherein the deformable insert allows the clamp to lengthen and contract while maintaining a clamping force on the implement arm.

The mechanism attaching a rotary brush assembly to a traction vehicle might also include a linkage that has a connecting rod. The connecting rod might have a first and second ball joint, attached to a first and second end of the connecting rod respectively. The first ball joint might be attached to the controlling surface on the implement arm, and the second ball joint might be attached to the brush assembly. The mechanism might also mount the brush assembly substantially below the implement arm.

BRIEF DESCRIPTION OF THE DRAWINGS

FIG. 3 is a rear elevational view of the brush assembly.

DETAILED DESCRIPTION OF A PREFERRED EMBODIMENT

Figure 1:
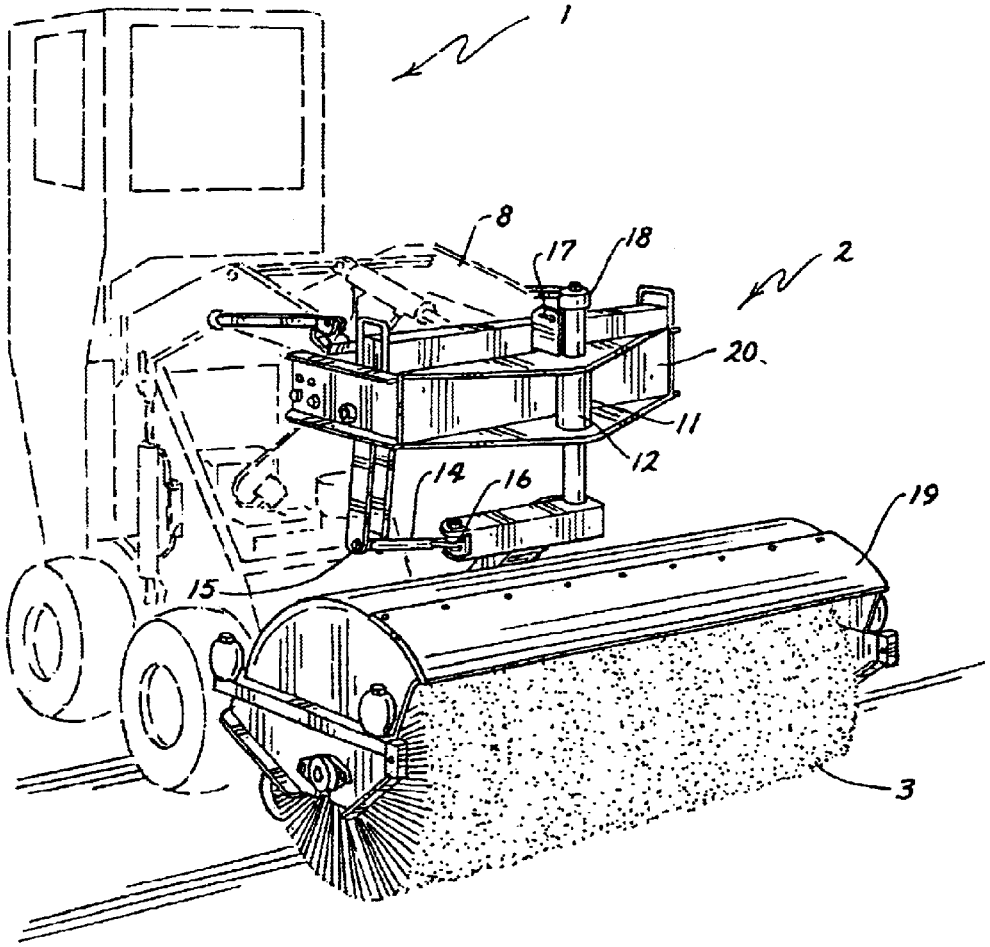
FIG. 1 is a perspective view illustrating the brush assembly of this invention attached in its preferred embodiment to a skid steered vehicle.

FIG. 1 shows the invention of a brush assembly 2 attached to a skid steer type vehicle 1 in its preferred embodiment. The brush assembly is divided into two main parts: a first frame 19 that holds a brush 3; and a second frame 20 that attaches directly to an implement arm 8 of the skid steered vehicle 1. The brush 3, in its preferred embodiment, is a transverse brush that is 48 inches wide with a diameter of 24 inches. The first and second frame of the brush assembly are connected together by a linear sliding joint 11 which, in the preferred embodiment, also acts as a yaw pivot joint 12. In the preferred embodiment as shown in FIG. 2, the axis 5 of the linear sliding joint 11 and the axis of rotation 5 of the yaw pivot joint 12 are coaxial and thus labeled the same.

One skilled in the art would recognize that the two axes would not have to be coaxial.

Figure 2:
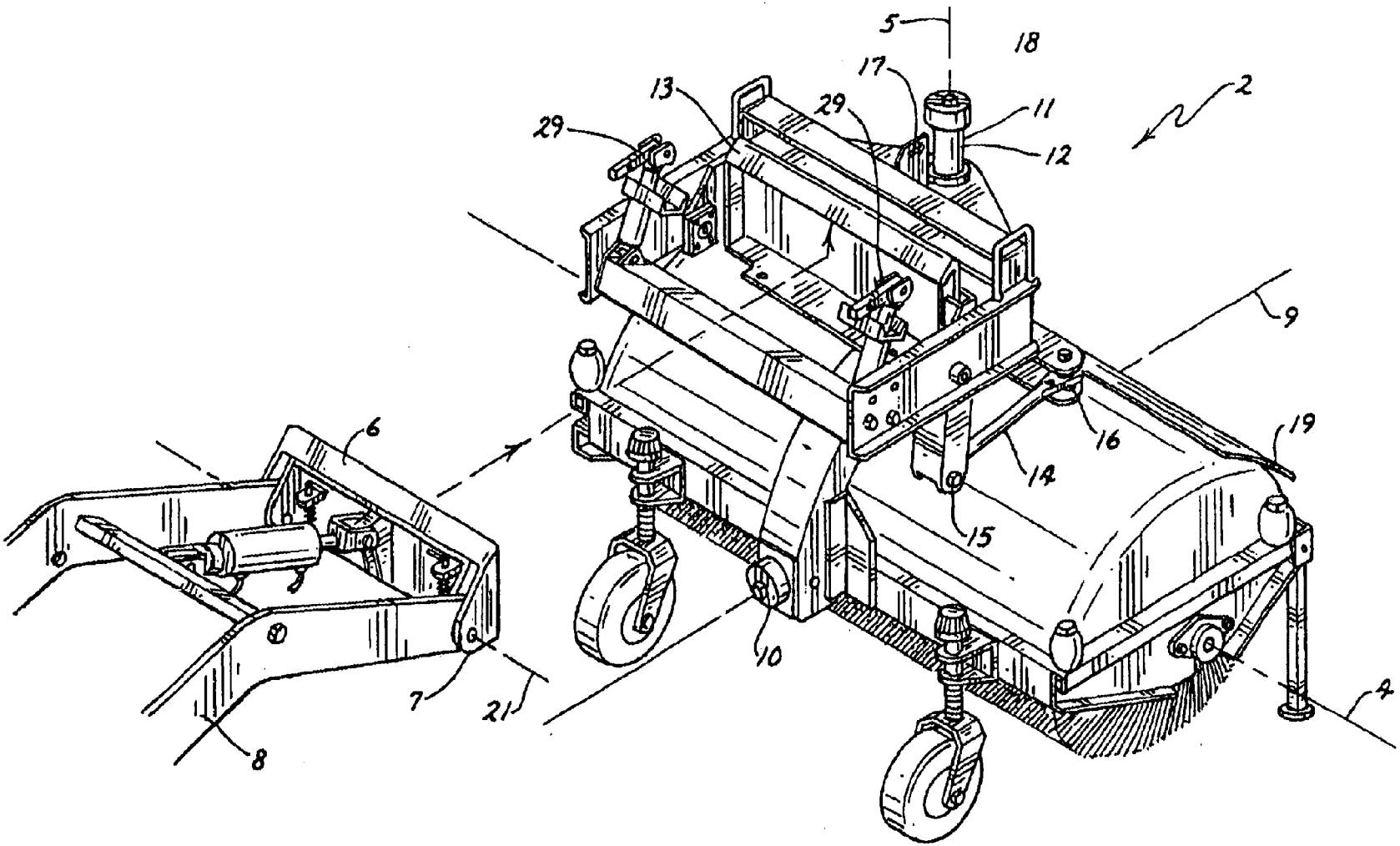
FIG. 2 is a perspective view illustrating the brush assembly in its unattached condition.

The axes and joints that permit motion of the brush assembly within its degrees of freedom are illustrated in FIG. 2. The brush 3 rotates about an axis of brush rotation 4 to sweep the surface of debris. In its preferred embodiment, the brush 3 is powered by a hydraulic motor (not shown), which is hydraulically connected to the skid steered vehicle's existing hydraulic system by hoses.

The brush assembly is free to rotate about a roll axis of rotation 9 as permitted by a roll pivot joint 10. The operator does not control roll rotation. This motion allows for accommodation of uneven ground features. When the brush 3 encounters a slanted surface, the roll pivot joint 10 allows the brush to tilt and conform to the slant. This can be seen in FIG. 3, where ghost lines 22 and 23 show roll to one side or the other. In the preferred embodiment, the roll joint permits rotation of five degrees in either direction.

Figure 5:
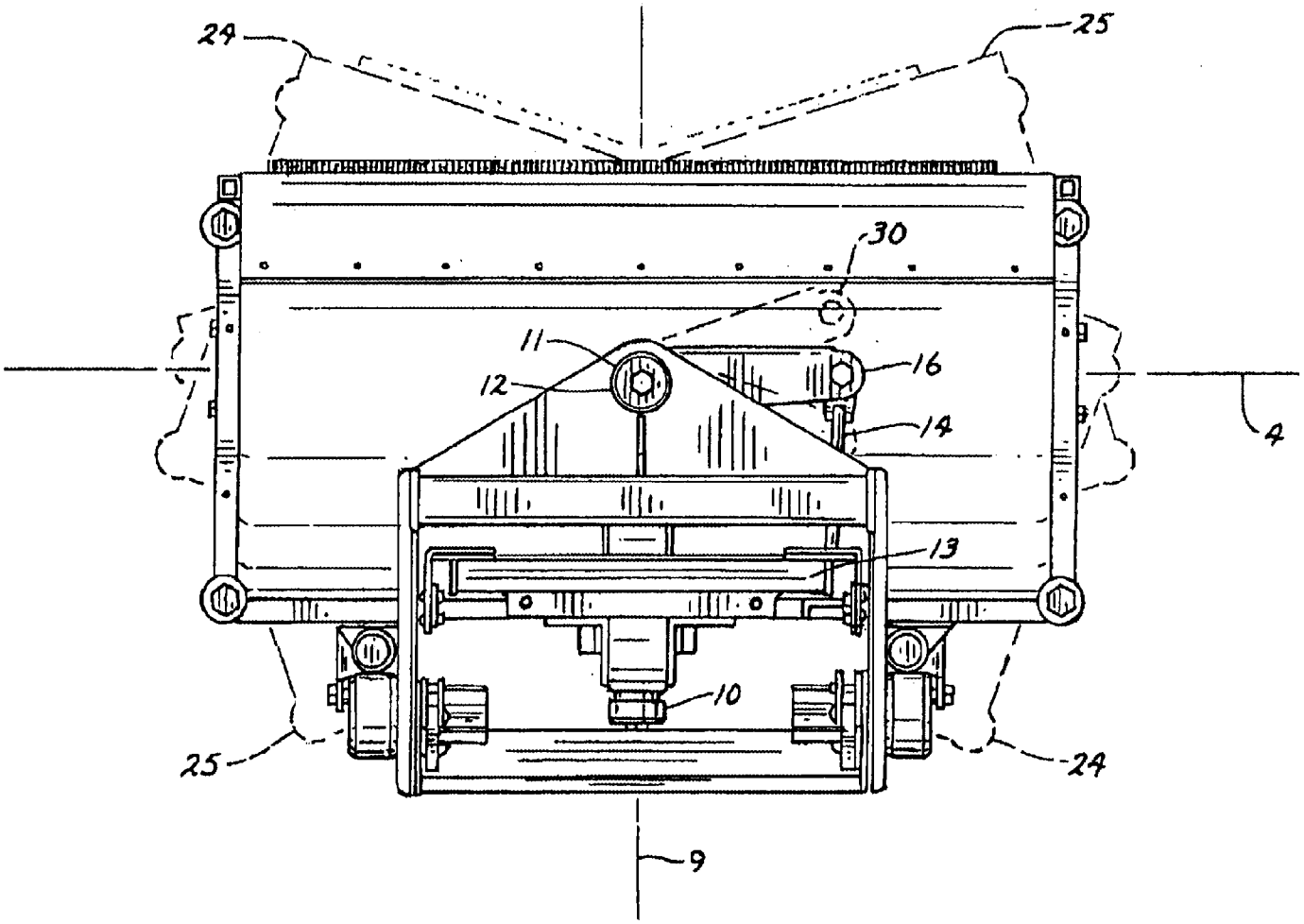
FIG. 5 is a top view of the brush assembly.

Rotation about a yaw axis of rotation 5 is facilitated by the yaw pivot joint 12. The operator controls yaw rotation. The first frame 19 can be moved to different yaw angles about the yaw axis of rotation 5, but yaw motion is not dictated by surface features as roll motion is. Yaw motion must be controlled by the operator so that he knows the direction of the debris being swept. In the preferred embodiment, the yaw angle is operator adjustable to 25 degrees in either direction. FIG. 5 illustrates yaw motion with ghost lines 24 and 25.

As previously mentioned, in the preferred embodiment, the axis of linear motion 5 is coaxial with the yaw axis of rotation 5 and the linear sliding joint 11 facilitates up/down linear motion. The use of the linear sliding joint to accommodate up and down motion allows the brush assembly to be located closer to the skid steered vehicle while still allowing a large range of up and down motion. In the preferred embodiment, the linear sliding joint allows at least 3 inches of travel in either direction. This is illustrated in FIG. 4 by ghost lines 26 and 27.

Figure 4:
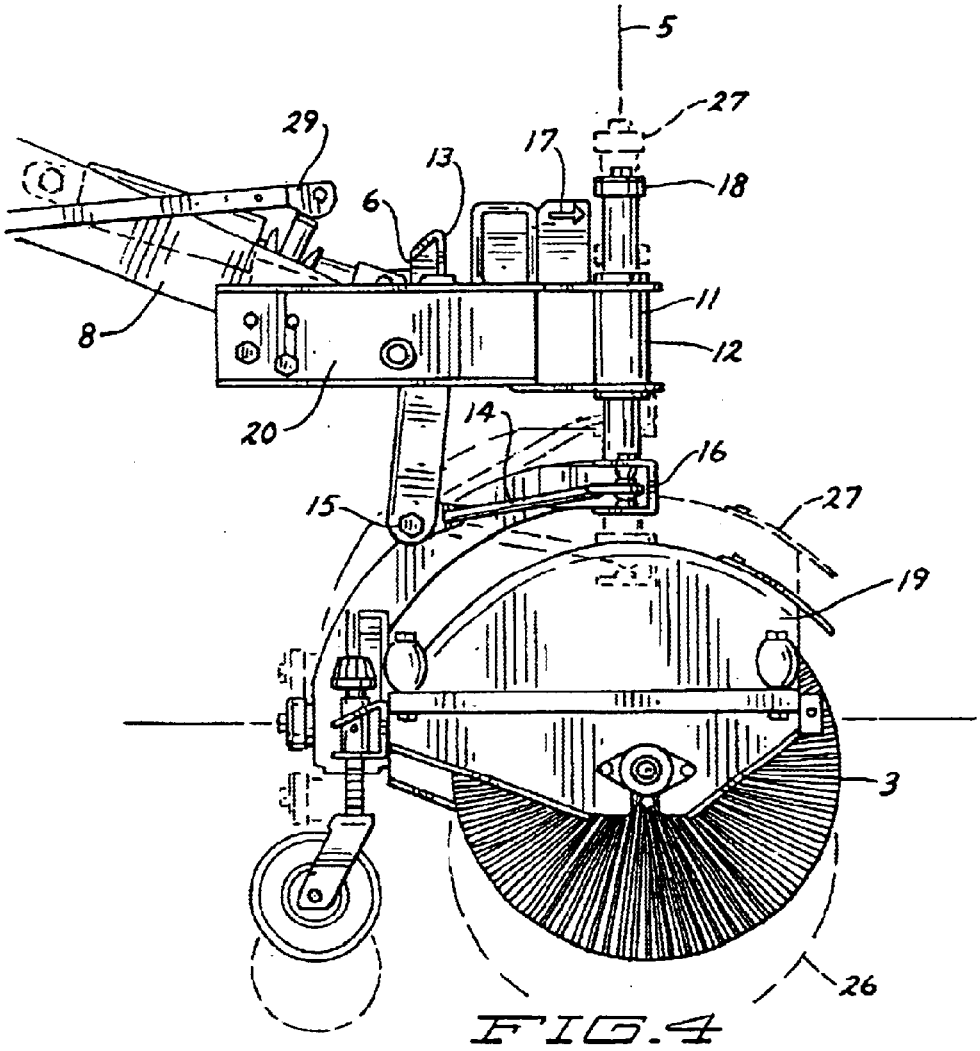
FIG. 4 is a side elevational view of the brush assembly attached in its preferred embodiment to a skid steered vehicle.

FIG. 4 shows the brush assembly 2 in its preferred embodiment as mounted to the implement arm 8 of the skid steered vehicle 1. Mounting is accomplished through the use of two over-the-center style clamps 29. The clamping arrangement of the brush assembly 2 to the implement arm 8 is designed in such a way as to allow the clamps 29 to lengthen and contract while maintaining a clamping force on the implement arm 8. This provides a more flexible connection of the brush assembly 2 to the skid steered vehicle 1. When the preferred embodiment encounters an obstacle in its sweeping path, the brush assembly 2 may be driven backward into the skid steered vehicle 1. In this scenario, the clamp 29 lengthens slightly to absorb the shock of the impact with the obstacle. After the impact of the brush assembly with the obstacle, the clamp 29 contracts to its "at rest" condition. Although during and after impact the length of the clamp 29 varies, a clamping force on the implement arm 8 is maintained at all times. The preferred configuration of a clamp 29 with the features of allowing lengthening and contracting while maintaining clamping force is shown in FIGS. 7, 8A, 8B, and 9.

Figure 9:
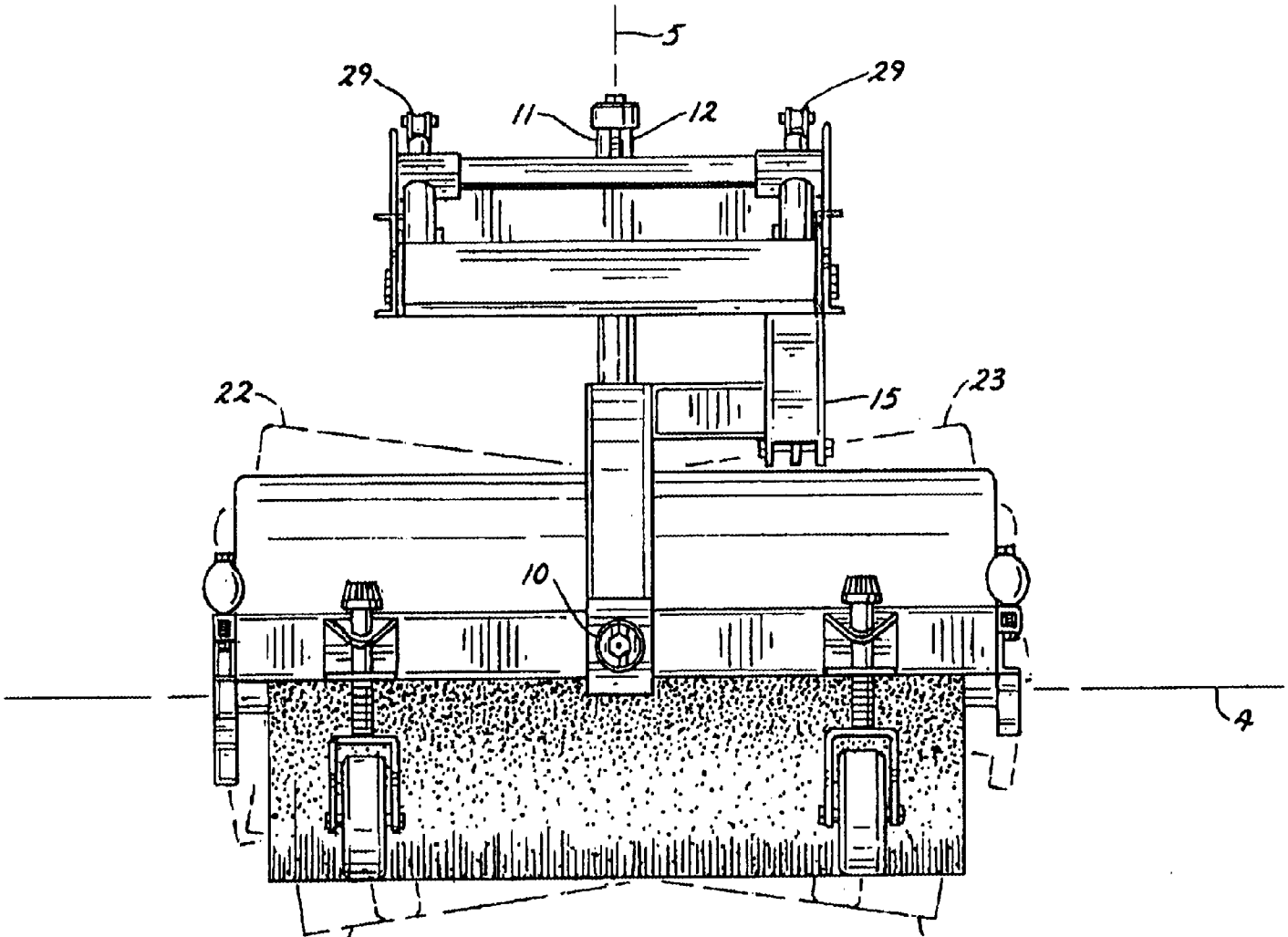
FIG. 9 is a perspective exploded view of a clamp for attaching the brush assembly to an implement arm.

FIG. 9 shows an exploded view of the clamp components. A cam 31 is used as a clamping actuator that applies a clamping force. The cam 31 is attached to a shaft 32. The shaft 32 passes through two washers 37, an elastomer insert 33 and a clamping surface 34 before it threads into an attachment point fixture 36. The attachment point fixture is connected to the second frame 20 of the brush assembly at a pivoting point 38. The clamping surface 34 is in contact with the implement arm 8 when the brush assembly is in its mounted condition. In the preferred embodiment, the elastomer insert 33 is located between the cam 31 and the clamping surface 34.

Figure 7:
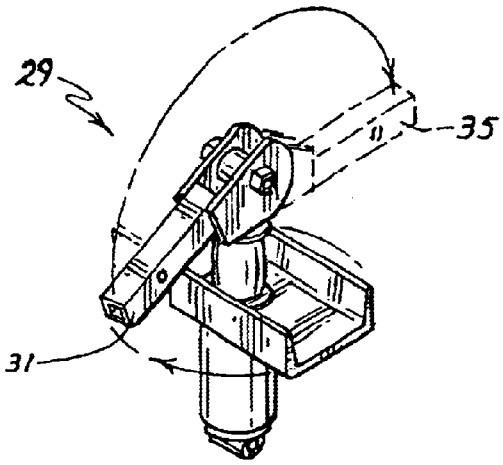
FIG. 7 is a perspective view illustrating a clamp for attaching the brush assembly to an implement arm.
Figure 8A:
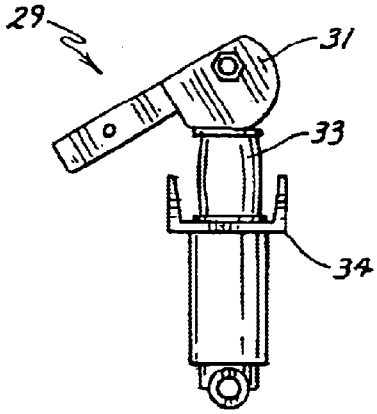
FIG. 8A is a side elevational view of a clamp for attaching the brush assembly to an implement arm shown in its clamped state.
Figure 8B:
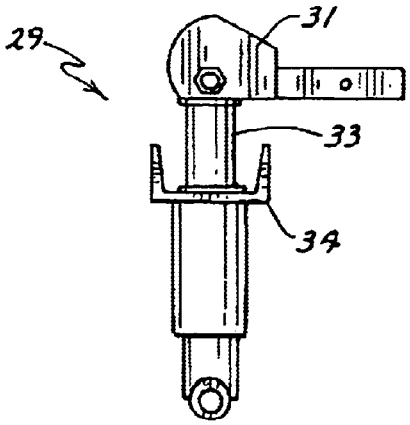
FIG. 8B is a side elevational view of a clamp for attaching the brush assembly to an implement arm shown in its unclamped state.
Figure 9:
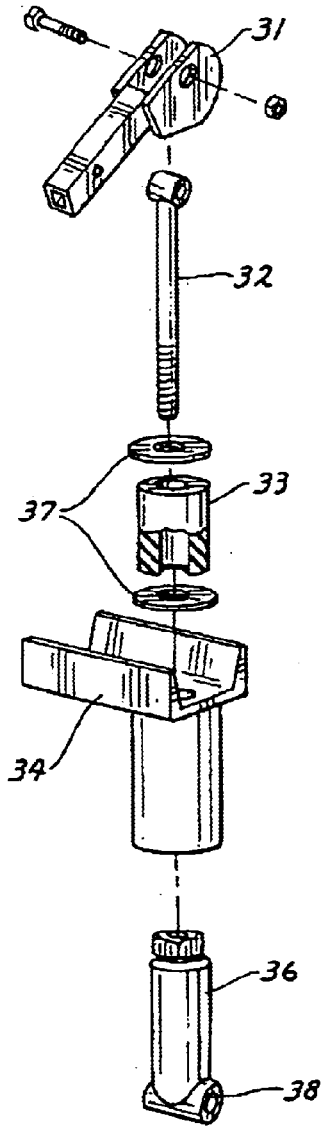

In an unclamped condition of the clamp 29, the cam 31 is "open" as shown in FIG. 8B. In this condition, no clamping force is being applied to the implement arm 8, and the elastomer 33 is uncompressed. The clamp 29 can also be in a clamped condition where the cam 31 is "closed" as shown in FIG. 8A. In the clamped condition, the clamp is applying a clamping force to the implement arm 8, and the elastomer 33 is in a compressed state. FIG. 7 illustrates the motion of cam 31 from the clamped to unclamped condition of the clamp 29. Ghost lines 35 indicate that the cam is "open" and the clamp is in its unclamped condition. The solid lines of the cam 31 show the closed and clamped condition of the clamp.

Before the impact with an obstacle in the scenario described above, the elastomer 33 is in an "at rest" compressed state in its normal clamped condition. An impact with an obstacle further compresses the elastomer 33 to allow the clamp 29 to lengthen. After the impact, the elastomer 33 relaxes to its "at rest" compressed condition. The elastic force of the compressed elastomer provides a clamping force that exists when the clamp 29 lengthens and when it contracts.

FIG. 2 also illustrates a controlling surface 6 of the implement arm 8. The skid steered vehicle in its preferred embodiment has the ability to rotate its controlling surface 6 about an axis of rotation 21 by means of an implement arm joint 7. In this invention the rotation of the controlling surface 6 is then used to control rotational motion of the brush assembly about the yaw axis of rotation 5. When the brush assembly 2 is mounted to the implement arm 8, the controlling surface 6 is mated with a mounting surface 13 on the brush assembly. The mating of the controlling surface 6 and the mounting surface 13 is only used to control the brush assembly. Structural mounting of the brush assembly 2 is accomplished through the use of the clamps 29 that fasten to the implement arm 8. Yaw motion is then controlled by rotation of the controlling surface 6, which is mated to the mounting surface 13.

Figure 6:
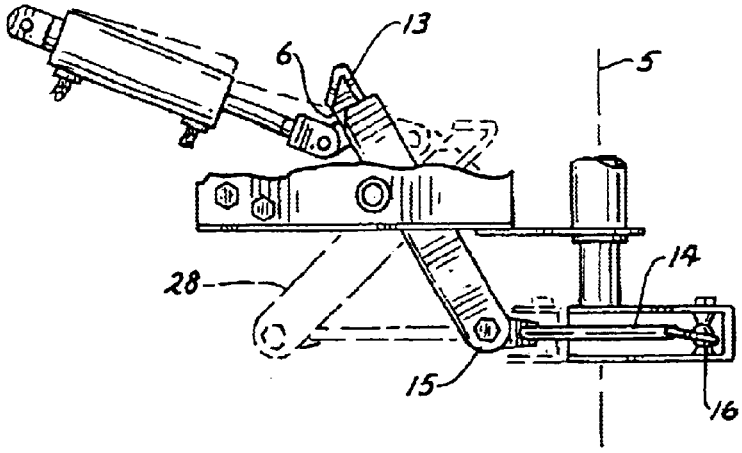
FIG. 6 is a side elevational view of the linkage that controls yaw motion.

The mounting surface 13 is attached to a first end of a linkage 14 that includes first 15 and second 16 ball joints attached to its ends. The second end of the linkage 14 is attached to the first frame 19 of the brush assembly 2. The linkage and ball joints act together to translate the rotation of the controlling surface 6 about axis 21 on the implement arm 8, into yaw rotation of the first frame 19 and attached brush 3. The motion of the linkage in this operation can be seen in FIG. 5 as shown by ghost lines 30, and in FIG. 6 as shown by ghost lines 28. By this method, the linkage in the preferred embodiment takes advantage of already existing hydraulic cylinders and controls on the skid steered vehicle 1 to control yaw motion of the brush assembly 2.

The ball joints 15,16 also allow up and down motion along the linear axis 5 without compromising the ability to control yaw motion as shown in FIG. 4. The ghost lines 26 and 27 of FIG. 4 show the motion of the first frame 19, and the linkage 14 as the first frame moves up and down along the linear sliding joint 11.

The range of motion of the up/down linear sliding joint 11 can be monitored through the use of markings 17 and 18. In the preferred embodiment, marking 17 is a sticker in the shape of an arrow, while marking 18 is a retaining ring on top of the linear sliding joint 11. When the arrow 17 on the second frame 20 is lined up with the ring 18 on the first frame 19 the operator knows that the linear sliding joint 11 is in the middle of its range of motion. Although in this embodiment, only an arrow and a ring are used, it would be apparent to one skilled in the art that any number of line markings or scales could also be used to indicate the position of the linear sliding joint. When the linear sliding joint 11 is centered using this system, the operator is able to optimize the use of the linear sliding joint by assuring that the first frame 19 will accommodate both large drops and rises in terrain.

For operation, the brush assembly 2 must be attached to the skid steered vehicle 1. The operator first positions the controlling surface 6 on the implement arm 8 in the mounting surface 13 of the brush assembly 2. The operator then positions the clamps 29 over the implement arm 8 and fastens them down into their clamped states. Next, the operator attaches the hydraulic lines for powering the hydraulic brush motor to the skid steered vehicle's hydraulic system. The implement arm 8 would then be moved up or down as needed to line up the first indicating marker 17 with the second indicating marker 18. When the two markers are aligned, the operator knows that the linear sliding joint 11 is in the middle of its range where it is the most effective. The brush is then ready for operation.

In operation, the yaw position of the brush may be angled to one side as desired in order to move debris in that direction. The skid steered vehicle 1 is then driven forward while rotating the brush 3. If the surface to be cleaned is wider than the 48 inches of brush width, more than one pass will be needed. After the first pass, the skid steered vehicle will turn around to take a second pass. At this point, the yaw position may be changed to brush debris in the same direction as the first pass. As the brush moves along each pass, the roll pivot joint 10 and the linear sliding joint 11 are free to move while the yaw pivot joint 12 is fixed by the operator. The roll pivot joint 10 accommodates uneven surface slants. The linear sliding joint 11 accommodates uneven surface heights. In this way, the surface is more effectively cleaned, and brush wear is minimized.

A preferred embodiment of the invention is described above. Those skilled in the art will recognize that many embodiments are possible within the scope of the invention. Variations and modifications of the various parts and assemblies can certainly be made and still fall within the scope of the invention. Thus, the invention is limited only to the apparatus and method recited in the following claims and equivalents thereof.

I claim:

1. An indicating device for monitoring the range of up and down motion in a rotary brush assembly comprising:

a) a first frame that holds a rotary brush;

b) a second frame for operatively connecting the first frame to a traction vehicle;

c) a joint allowing up and down motion of the first frame relative to the second frame;

d) a first indicating marker that is operatively connected to the first frame; and e) a second indicating marker operatively connected to the second frame wherein the degree of movement between the first frame and the second frame is indicated by the first and second indicating markers.

2. The indicating device of claim 1 wherein the rotary brush rotates about an axis of rotation substantially parallel to the ground.

3. The indicating device of claim 1 wherein the joint is a linear sliding joint.

4. The indicating device of claim 1 wherein the first and second indicating markers are comprised of line markings.

5. An indicator for monitoring the range of motion in a rotary brush assembly, said visual indicator comprising:

a first frame upon which a rotary brush is coupled;

a second frame for operatively coupling the first frame to a traction vehicle;

a joint allowing motion of the first frame relative to the second frame;

a first indicating marker being operatively coupled to the first frame; and a second indicating marker being operatively coupled to the second frame, wherein a degree of movement between the first frame and the second frame is visually indicated by the first and second indicating markers.

6. The indicator of claim 5 wherein the rotary brush rotates about an axis of rotation substantially parallel to the ground.

7. The indicator of claim 5 wherein the joint is a linear joint.

8. The indicator of claim 7 wherein the joint is a sliding linear joint.

9. The indicator of claim 5 wherein the first and second indicating markers are line markings.

10. An indicator device for a rotary brush assembly for use with a traction vehicle, said indicator device comprising;

an implement arm extending from the traction vehicle;

a controlling surface located at the end of the implement arm;

a pivot joint located at the end of the implement arm about which the controlling surface rotates, the pivot joint having an axis of rotation;

a first frame that holds a rotary brush;

a second frame that is operatively coupled to the implement arm;

a frame joint located between the first and second frame, permitting motion of the first frame relative to the second frame;

a linkage operatively coupled to the controlling surface and the first frame translating pivoting motion of the controlling surface about the pivot joint axis of rotation into motion of the first frame relative to the second frame;

a first indicating marker that is operatively connected to the first frame; and a second indicating marker operatively connected to the second frame wherein a degree of motion between the first frame and the second frame is indicated by the first and second indicating markers.

11. The indicator device of claim 10 wherein the frame joint is a linear joint.

12. The indicator of claim 11 wherein the frame joint is a sliding linear joint.

13. The indicator device of claim 10 wherein the first and second indicating markers are comprised of line markings.

* * * * *